US005202700A

United States Patent [19]

Miller

[11] Patent Number: 5,202,700

[45] Date of Patent: Apr. 13, 1993

[54] ARRAY FED REFLECTOR ANTENNA FOR TRANSMITTING & RECEIVING MULTIPLE BEAMS

[75] Inventor: Coleman J. Miller, St. Petersburg, Fla.

[73] Assignee: Westinghouse Electric Corp., Pittsburgh, Pa.

[21] Appl. No.: 645,317

[22] Filed: Jan. 24, 1991

Related U.S. Application Data

[63] Continuation of Ser. No. 267,088, Nov. 3, 1988, abandoned.

[51] Int. Cl.[5] ..... H01Q 19/17

[52] U.S. Cl. ..... 343/840; 343/914

[58] Field of Search ..... 343/781 R, 914, 781 P, 343/840, 775, 776, 779, 781 CA

[56] References Cited

U.S. PATENT DOCUMENTS

| | | | |
|---|---|---|---|
| 2,668,869 | 2/1954 | Iams | 343/755 |
| 3,696,435 | 10/1972 | Zucker | 343/840 |
| 3,914,768 | 10/1975 | Ohm | 343/779 |
| 3,964,071 | 6/1976 | Townes et al. | 343/840 |
| 4,090,203 | 5/1978 | Duncan | 343/797 |
| 4,338,608 | 7/1982 | Strauch et al. | 343/840 |
| 4,482,897 | 11/1984 | Dragone et al. | 343/781 P |
| 4,535,338 | 8/1985 | Ohm | 343/781 CA |
| 4,554,552 | 11/1985 | Alford et al. | 343/840 |
| 4,786,910 | 11/1988 | Dragone | 343/781 R |
| 4,951,059 | 8/1990 | Taylor, Jr. | 342/374 |
| 4,965,604 | 10/1990 | Taylor, Jr. | 342/155 |

*Primary Examiner*—Michael C. Wimer
*Attorney, Agent, or Firm*—R. P. Lenart

[57] ABSTRACT

An array fed reflector antenna includes a reflector and a distributed feed array. The reflector has a portion with a dual parabolic shape. The distributed feed array transmits and receives a plurality of electromagnetic energy beams simultaneously, and is positioned adjacent the reflector so that the reflector reflects the transmitted and received electromagnetic energy beams. The distributed feed array is offset from the reflector so that a plane wave formed by the transmitted electromagnetic energy beams reflected by the reflector will not substantially impinge the distributed feed array. The antenna also has a beam switching network which is a hybrid network for selectively actuating separate but overlapping portions of the distributed feed array to produce two transmit elevation beams.

6 Claims, 15 Drawing Sheets

ARRAY FED REFLECTOR ANTENNA FOR TRANSMITTING & RECEIVING MULTIPLE BEAMS

This application is a continuation of application number 07/267,088, filed 11/3/88, now abandoned.

BACKGROUND OF THE INVENTION

This invention is directed to an antenna for use in radar systems, and particularly to an array fed reflector antenna with multiple elevation beams.

There exist, a number of different types of antennas for use in radar systems. One type of antenna for use in radar systems is a multiple elevation beam reflector antenna which employs a vertically centered feed system, such as the model TPS-43 antenna manufactured by Westinghouse Electric Company. This antenna employs multiple feed horns which feed a reflector, and has the advantage of low cost. However, since a vertically centered feed system is employed, the antenna produces a large amount of blockage of the reflected beams, which is caused by this centered feed arrangement. Further, this type of reflector is only capable of horizontal polarization and has an azimuth sidelobe specification of 25 dB.

Another type of antenna system is the model TPS-70 antenna manufactured by Westinghouse Electric Company. This antenna is a planar array antenna with a matrix beamformer which uses edge slotted waveguide elements and achieves ultra-low sidelobes in azimuth. While the performance of the model TPS-70 is much better than the TPS-43, the cost of the TPS-70 is much greater than the TPS-43. Furthermore the model TPS-70 has certain disadvantages in that it squints and only radiates one polarization.

While the existing antennas of the type described above work well for their intended purpose, in fact the best performance for an existing reflector antenna only achieves 25 to 28 dB sidelobes. Thus, there is a need in the art for an antenna which provides the improved performance of a planar array antenna (such as the model TPS-70) while at the same time having a relatively low cost (such as the model TPS-43). Further, there is a need in the art for an antenna which achieves a planar wave front and produces three-dimensional detection, so that the angle of the target with respect to the horizon can be determined.

In prior art multiple elevation beam antennas, there exist devices which allow azimuth rows of electromagnetic energy radiating elements to be shared when several transmit elevation beams are to be formed. Available devices for allowing the sharing of such azimuth rows typically have taken the form of a switch which alternately actuates a low transmit beamformer and a high transmit beamformer. When the high transmit beamformer is actuated, the high transmit beamformer will drive both a set of high transmit azimuth rows and a set of shared transmit azimuth rows. When the low transmit beamformer is switched on, the low transmit beamformer will actuate both a set of low transmit azimuth rows and the set of shared transmit azimuth rows. This approach has inherent problems due to the reliability, power handling, and speed of the switches. Further, the combination of switches and networks required in this type of system tends to be very complex and costly. Thus, there is a need in the art for a simple and inexpensive means of providing a switching function, so that a set of shared transmit azimuth rows can be alternately actuated for two transmit elevation beams.

SUMMARY OF THE INVENTION

It is an object of the present invention to provide an antenna which overcomes the deficiencies of prior art antennas.

In particular, it is an object of the present invention to provide an array fed reflector antenna having multiple elevation beams, which is capable of producing low sidelobes.

It is another object of the present invention to provide a transmit beam switching network which overcomes the deficiencies of prior art beam switching networks.

In particular, it is an object of the present invention to provide a hybrid transmit beam switching network in which selection of the beam to be transmitted is based on a phase shift rather than switch actuation.

The antenna of the present invention includes means for transmitting and receiving a plurality of electromagnetic energy beams simultaneously. In addition, the antenna includes means for reflecting the simultaneously transmitted energy beams into free space over a predetermined angle and for reflecting the received electromagnetic energy beams onto the transmitting and receiving means. The reflecting means causes the transmitted electromagnetic energy beams to form plane waves. The transmitting and receiving means is offset from the reflecting means so that the plane waves do not impinge the transmitting and receiving means.

In a preferred embodiment, the reflecting means comprises a reflector having a portion with a dual parabolic shape, and the transmitting and receiving means comprises a distributed feed array for transmitting and receiving a plurality of electromagnetic energy beams simultaneously. The distributed feed array is positioned adjacent the reflector so that the reflector reflects the transmitted and received electromagnetic energy beams. The distributed feed array is offset from the reflector so that a plane wave formed by the transmitted electromagnetic energy beams reflected by the reflector will not substantially impinge the distributed feed array.

As described above, the antenna of the present invention employs an offset distributed feed array to substantially eliminate feed blockage. However, this offset causes distorted amplitude and phase across the reflector. Therefore, the phase distortion is corrected by widening and shaping the distributed feed array in the horizontal plane. The horizontal focal length of the reflector is lengthened and the surface of the feed array is contoured and angled so that each slice through the surface of the feed array (i.e., each azimuth row of electromagnetic energy radiating elements) creates a unique electromagnetic energy beam. The unique electromagnetic energy beams of groups of azimuth rows of radiating elements are combined to form low sidelobe elevation beams. Where close low sidelobe beams are to be formed, the azimuth rows are shared. With proper amplifier-combiner configuration, this can be done without sharing loss.

A significant advantage of the antenna of the present invention is that circular polarization can be integrated into the design at each azimuth row by employing a single phase shifter. The advantage of the antenna of the present invention over other antennas capable of forming multiple elevation beams is that circular polarization is economically feasible with a great reduction in the number of azimuth rows of radiating elements and low noise amplifiers when compared to planar array antennas. Further, few phase shifters are required as compared to other antenna systems which employ circular polarization. The antenna of the present invention has a number of other advantages in that it provides a configuration which correlates azimuth rows with beam elevation angles, by separating the row inputs for respective beams. In addition, the advantageous magnification provided by using a reflector is combined with the control achieved by employing a feed array to minimize the number of energy radiating elements required to achieve multiple elevation beams over a wide elevation coverage. Finally, circular polarization can be incorporated into these azimuth rows relatively efficiently, without compromising performance.

The present invention is also directed to a beam switching network for an antenna which produces a plurality of transmit electromagnetic energy beams using a feed array having first transmit rows, second transmit rows and shared transmit rows, based on a transmit signal. The beam switching network comprises means for providing first and second beam actuation signals based on the transmit signal. The first beam actuation signal is shifted by a means for phase shifting. The first transmit rows are turned on by means for turning on the first transmit rows based on the first and second beam actuation signals. The second transmit rows are actuated by a means for turning on the second transmit rows based on the first and second beam actuation signal. The shared rows are actuated by a means for turning on the shared rows with a first profile when the first transmit rows are actuated and for turning on the shared rows with a second profile when the second transmit rows are actuated. The beam switching network comprises a hybrid network which achieves switching between the first and second transmit beams based on a phase difference between the first and second beam actuation signals. The use of this hybrid network produces a circuit which is more reliable and faster than available switching circuits.

These together with other objects and advantages, which will become subsequently apparent, reside in the details of construction and operation as more fully hereinafter described and claimed, reference being had to the accompanying drawings, forming a part hereof, wherein like numerals refer to like parts throughout.

DETAILED DESCRIPTION OF THE PREFERRED EMBODIMENTS

Figure 1:
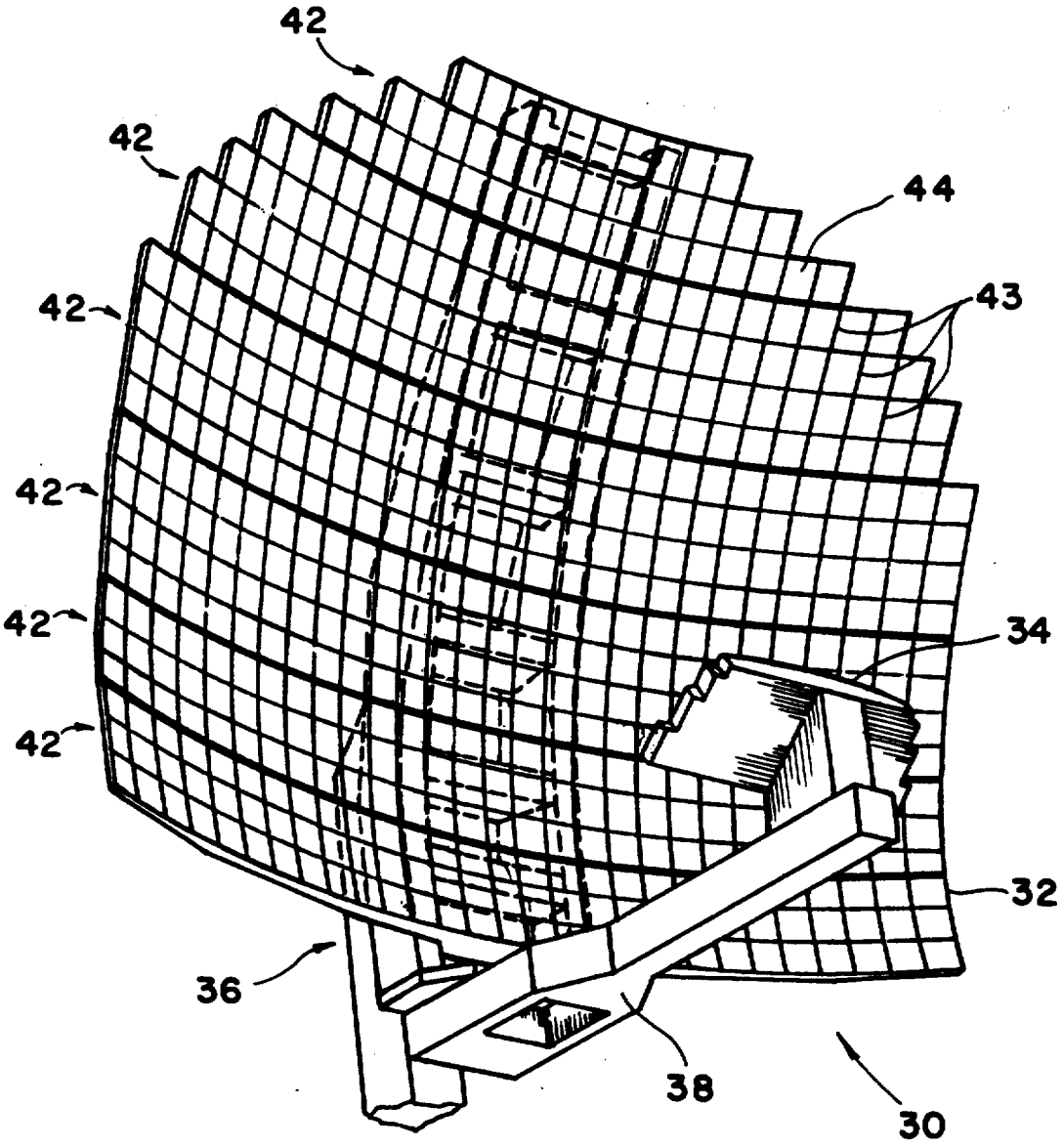
FIG 1 is a perspective view of an embodiment of an antenna in accordance with the present invention which was actually built by the Assignee of the subject application.

FIG. 1 is a perspective view of an embodiment of an antenna 30 in accordance with the present invention. The antenna 30 shown in FIG. 1 was built as a demonstration antenna by the Assignee of the subject application. The antenna 30 has been designed for use in an air route surveillance radar system which is a radar system which is deployed along air routes between airports and about the perimeter of a territory or any other boundary for which radar detection is desired. This is in contrast to an airport surveillance radar system (such as the prior art Westinghouse ASR9 system) which is the type of system used at an airport.

It should be noted that an air route surveillance radar system includes a number of subsystems including an antenna, transmitter, receiver, communication links and other subsystems. The present invention is directed solely to the antenna.

The antenna 30 is an array-fed aperture, with switchable vertical-linear/circular polarization capability, and dual elevation stack beams. The primary components of the antenna 30 include an aperture or reflector 32 and a distributed feed array 34. The distributed feed array 34 forms a means for transmitting and receiving a plurality of electromagnetic energy beams simultaneously. The reflector 32 forms a means for reflecting the simultaneously transmitted electromagnetic energy beams into free space at a predetermined angle and for reflecting the simultaneously received electromagnetic energy beams onto the distributed feed array 34. The reflector 32 causes the transmitted electromagnetic energy beams to form plane waves. Further, the reflector 32 and distributed feed array 34 are offset from each other so that the plane waves do not substantially impinge the distributed feed array. The reflector 32 is supported by a support 36, while the feed array 34 is supported by a support 38 which is coupled to the support 36. The supports 36 and 38 have an aluminum box-beam construction and are coupled to a base (not shown) in a rotatable fashion, so that the supports 36 and 38 (and hence the reflector 32 and the feed array 34) can be continuously rotated by 360° to achieve complete scanning by the radar system.

As illustrated in FIG. 1, the reflector 32 is formed by a plurality of grid panels 42 which are connected together to form the reflector 32 in the desired shape. Each of the grid panels 42 has a plurality of cross members 43, so that an open grid is formed, and a mesh 44 is spot welded to the grid panels 42. In the preferred embodiment, the grid panels 42 are formed by sheet metal construction and the mesh is expanded aluminum having a mesh size which is ⅝ inch (1.59 cm) square.

In accordance with the present invention, the feed array 34 is offset so that it is not positioned directly in front of the reflector 32 so as to substantially prevent planar waves which are being reflected by the reflector 32 from impinging the feed array 34. A distributed feed array 34 is provided to compensate for phase and amplitude distortion which is produced by this offsetting of the feed array 34.

Figure 2:
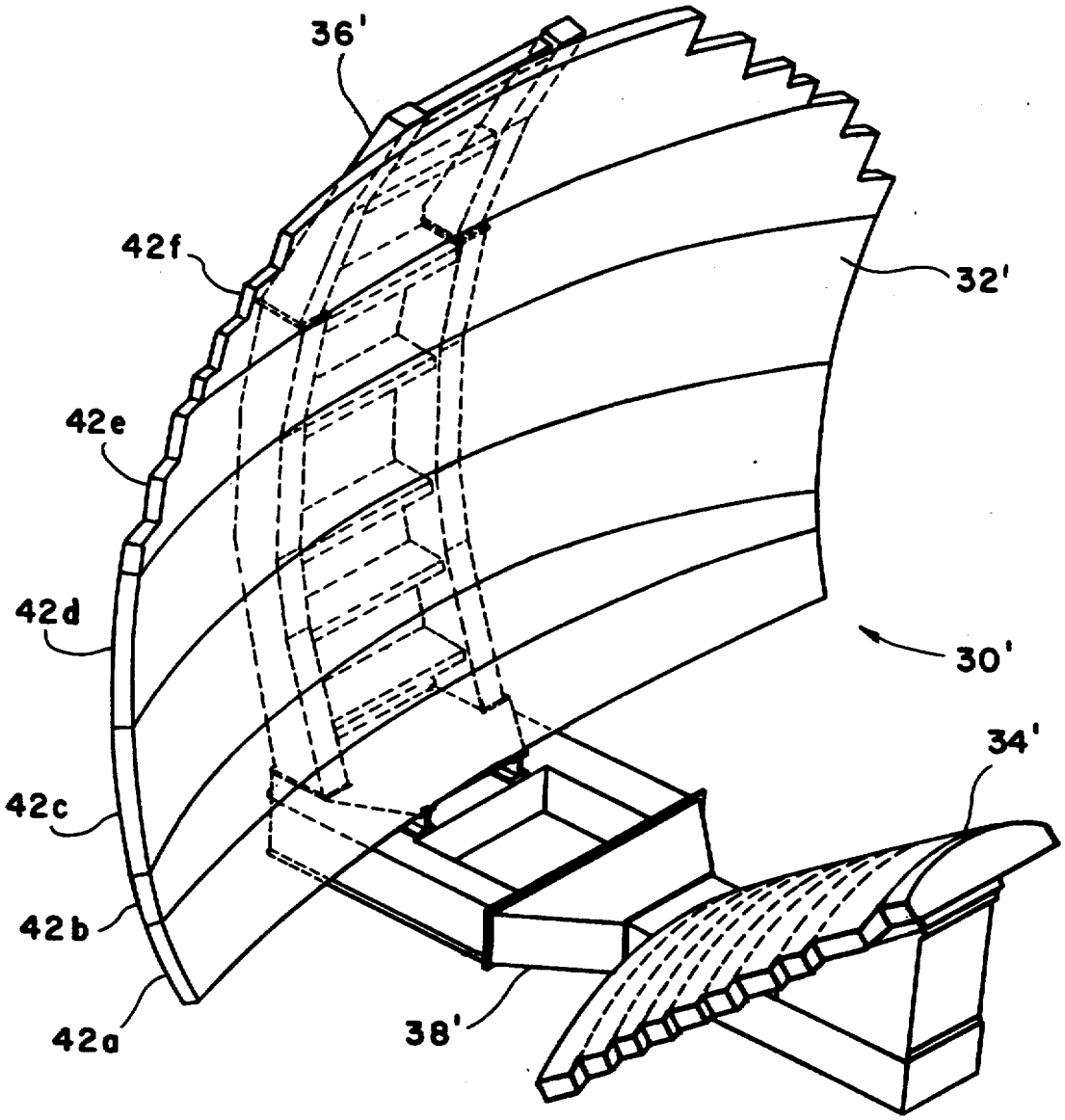
FIG. 2 is a schematic perspective view of a embodiment of the antenna of the present invention.

FIG. 2 is a schematic perspective view of a preferred embodiment of the antenna 30. Since the preferred embodiment has some features which are not found in the demonstration antenna 30 in FIG. 1, prime (') notation is used to distinguish the corresponding portions of FIG. 2. However, it should be noted that the basic structure and operation of antenna 30 of FIG. 1 and antenna 30' of FIG. 2 are the same. However, the demonstration antenna of FIG. 1 was built to produce three receive elevation beams, whereas in the preferred embodiment illustrated in FIG. 2, the antenna 30' is capable of generating nine receive elevation beams. As illustrated in FIG. 2, the reflector 32' is a doubly-curved reflector aperture, a portion of which has a dual parabolic shape. For purposes of description, the panels 42 forming the reflector 32' are separately identified as panels 42*a*–42*f* in FIG. 2. Panels 42*c*, 42*d*, 42*e* and 42*f* are connected together to form a dual parabolic contour. The only modification to this dual parabolic shape is that the upper corners of panels 42*e* and 42*f* are modified to have a stepped configuration, so that the reflector 32' fits within the minimum radome diameter. The radome (not shown) is the external cover which surrounds the antenna 30' to protect the antenna 30' from inclement weather. The bottom panels 42*a* and 42*b* are also modified from the dual parabolic contour so that these panels are able to provide elevation beams at 20° to 30° above the horizon.

Figure 3A:
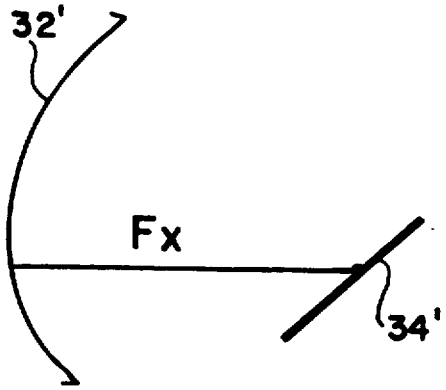
FIGS. 3A and 3B are diagrams for illustrating the vertical focal length and the azimuth focal length for the antenna of the present invention.
Figure 3B:
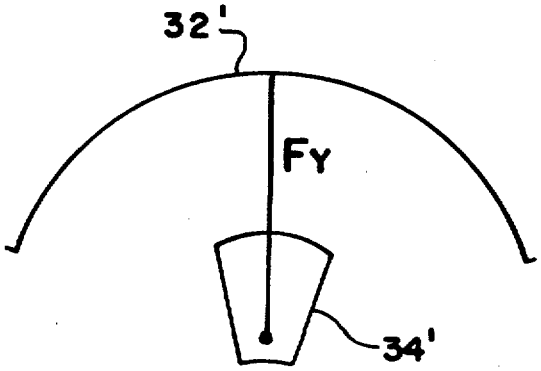

The dual parabolic structure of the reflector 32' produces two focal points as illustrated in FIGS. 3A and 3B. As illustrated in FIG. 3A which is a schematic side view of the reflector 32' and feed array 34', the dual parabolic contour of the reflector 32' produces a vertical focal length $F_x$. In the preferred embodiment, the vertical focal length $F_x$ is 18 feet (5.49 meters) in elevation. FIG. 3B is a schematic top view of the reflector 32' which is used to illustrate that the dual parabolic contour of the reflector 32' produces an azimuth focal length which is 26 feet (7.92 meters) from the center line of the reflector 32'.

Figure 4:
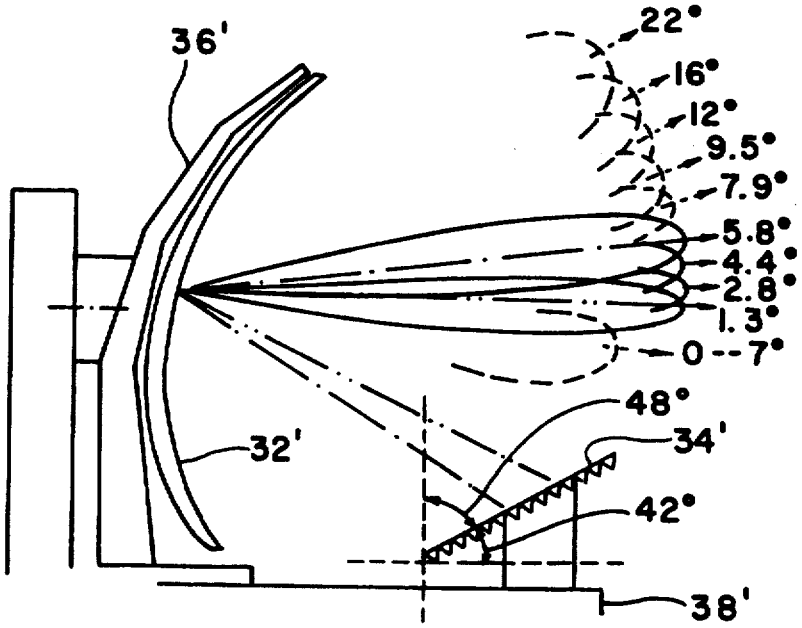
FIG. 4 is a side view of the antenna of the present which illustrates received elevation beams being reflected by the reflector.

FIG. 4 is a side view showing the relative positioning of the feed array 34' and the reflector 32'. In the preferred embodiment, the feed array is presented at an angle which is substantially 42° to the horizontal or approximately 48° to the vertical. Further, in the preferred embodiment, the reflector has a 2.3° tilt back. As illustrated in FIG. 4, the feed array 34' receives elevation beams which are reflected by the reflector 32' at angles of 0° to 22° with respect to the horizon. As explained above, lower panels 42*a* and 42*b* of the reflector 32' provide elevation coverage for the angles from 20° to 30°.

Figure 5:
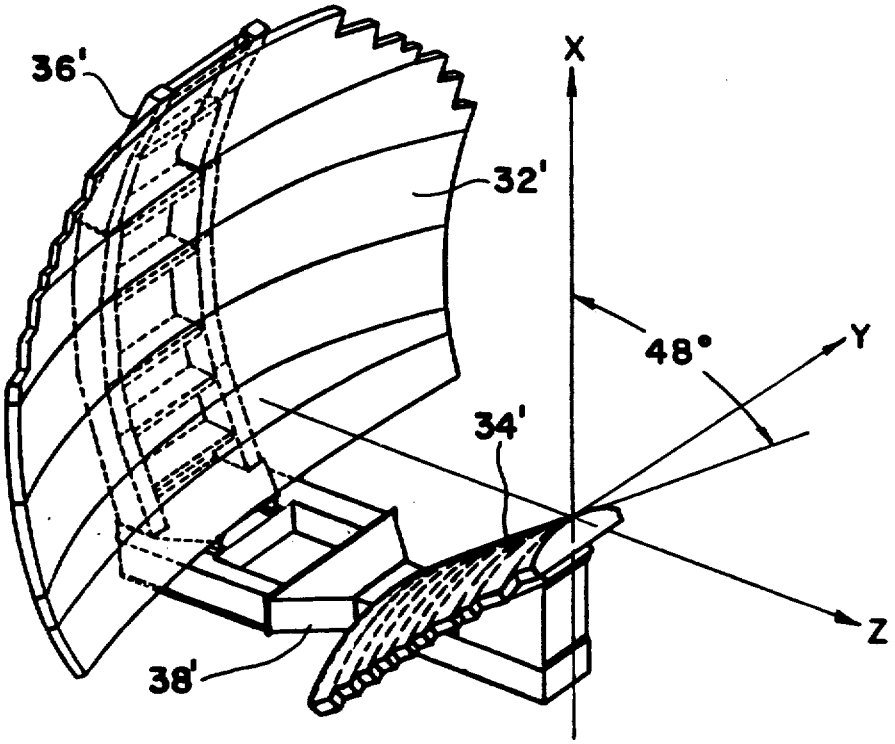
FIG. 5 is a diagram of a coordinate system for describing the relative positioning of the reflector 32 and the distributed feed array 34.

In the preferred embodiment, the shape of the dual parabolic contoured portion of the reflector 32 (i e., panels 42*c*–42*f*) is defined by the equation $$z=x^2/(4F_x)+y^2/(4F_y)+Cxy^2-F_x \quad (1)$$

for a reflector 32' pointing in the positive z direction as illustrated by the positioning of the reflector 32' and feed array 34' in the coordinate system illustrated in FIG. 5. In equation (1), x is the vertical dimension, y is the horizontal dimension, $F_x$ is the vertical focal length, $F_y$ is the horizontal (i.e., azimuthal) focal length, and C is a constant. In the preferred embodiment, $F_x=18$ feet (5.49 meters), $F_y=26$ feet (7.92 meters) and $C=0.00005$. The parameters of the preferred embodiment were obtained based on the structure of the feed array 34' and the relative positioning between the feed array 34' and the reflector 32'.

Figure 6:
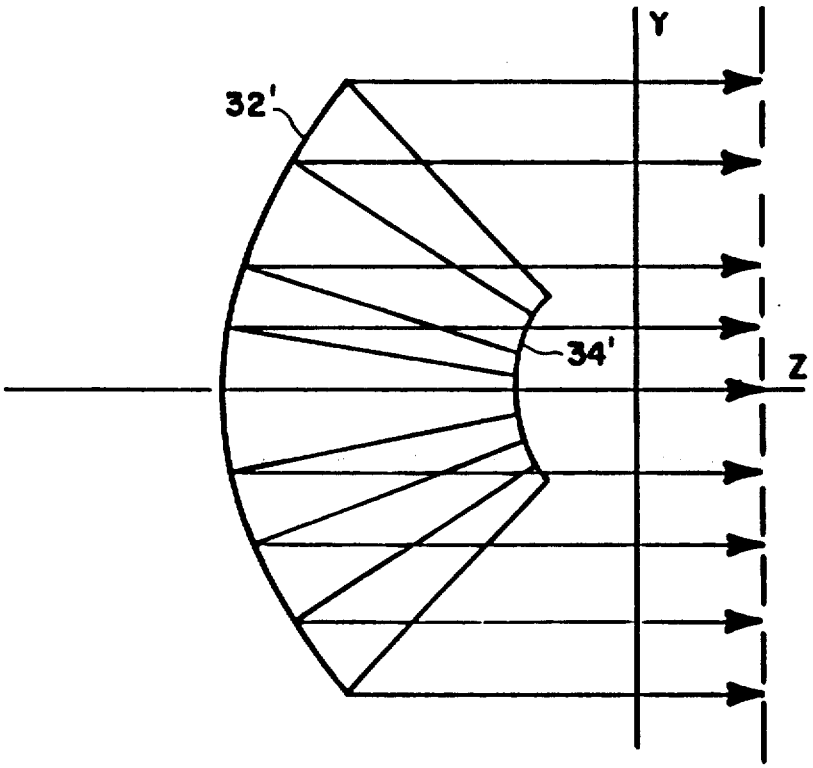
FIG. 6 is a diagram for illustrating the planar wavefront generated by the distributed feed array 34 of the present invention.
Figure 7:
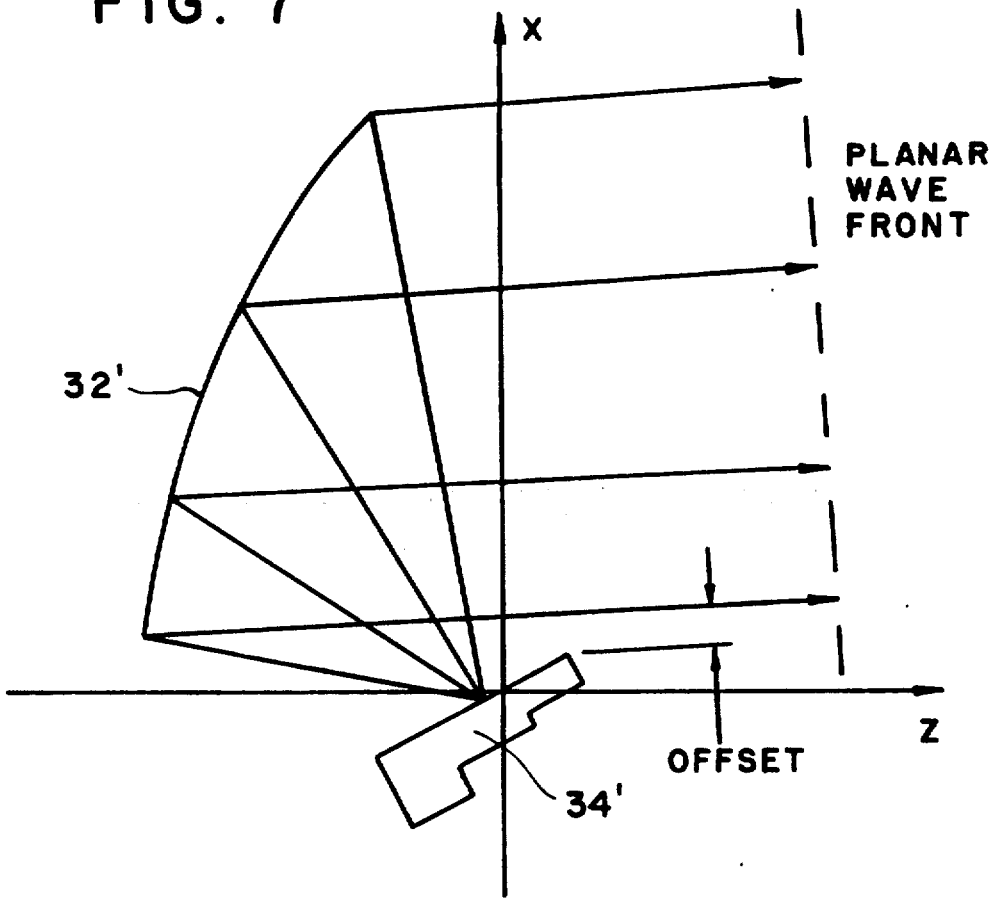
FIG. 7 is a diagram for illustrating the offset of the feed array 34 from the reflector 32 in accordance with the present invention.

FIGS. 6 and 7 are schematic diagrams for illustrating the results of the distributed feed array 34' and the offset positioning of the feed array 34'. As illustrated in FIG. 6, the feed array 34' has a distributed feed and a curved surface. Thus, the feed array 34' is spread out instead of being in-line, in order to give phase and amplitude control required to produce lower sidelobes. As a result, the wavefront reflected by the reflector 32' can be corrected so that it is planar and has low distortion. In particular, the geometry of the feed array 34' is based on the focal lengths $F_x$ and $F_y$ and the shape of the reflector 32'. As a result, the distribution of the elevation beams can be controlled so that the resulting antenna pattern has low sidelobes.

FIG. 7 illustrates the offsetting of the feed array 34' from the reflector 32', so that the planar wavefront which is produced by the reflector 32' does not impinge the feed array 34'. That is, in accordance with the antenna structure of the present invention, the feed blockage prevalent in the prior art is eliminated. However the elimination of feed blockage causes a distorted amplitude and phase across the reflector 32'. The phase is corrected by widening and shaping the feed system in the horizontal plane. To compensate for this, the horizontal focal length of the reflector 32' is lengthened. Further, the feed surface is contoured and angled so that each slice through the feed surface (i.e., a row of radiating elements as described below) creates a unique electromagnetic energy beam.

Figure 8:
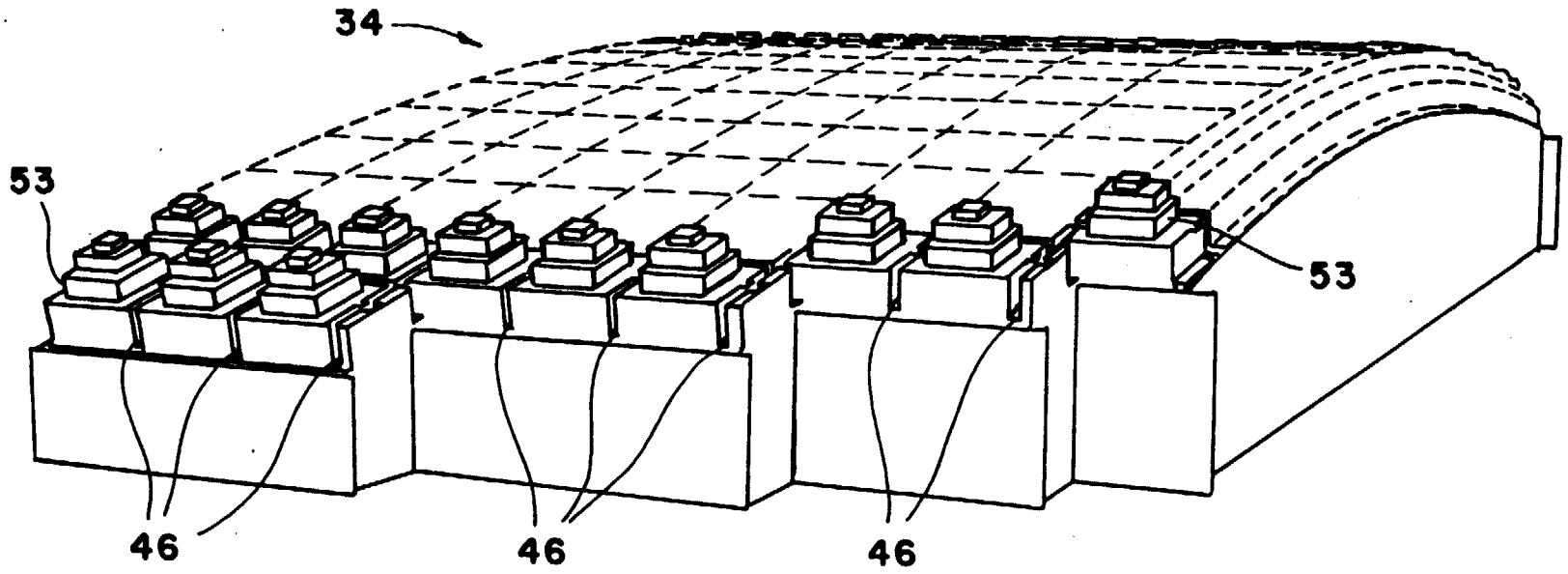
FIG. 8 is a perspective view of the feed array 34 of FIG. 1.

FIG. 8 is a perspective view of the feed array 34 which was actually built as part of the demonstration antenna of FIG. 1. The feed array 34 has a cylindrical surface with a 24 foot (7.32 meters) radius of curvature, and is made up of a series of rows 46, each of which extends across the feed array 34. The reflector 32 and feed array 34 are curved so that the mapping over the entire usable reflector surface, from each direction, maps into a line (or row 46) of the feed surface. In this way, each row 46 acts like a single feed horn except that each row forms a low azimuth sidelobe pattern due to its amplitude and phase, and the location of its elements. In this demonstration antenna, a reflector 34 having eight azimuth rows 46 was built. However, in the preferred embodiment of FIG. 2, 24 azimuth rows 46 are employed. Each of the rows 46 is made up of air dielectric stripline circuitry.

Figure 9:
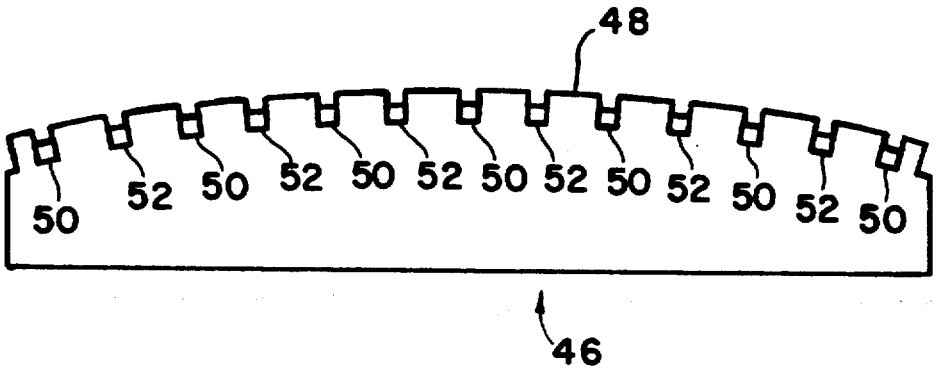
FIG. 9 is a schematic side view of one of the rows 46 of FIG. 8.

FIG. 9 is a schematic side view of one of the azimuth rows 46 of FIG. 8. As illustrated in FIG. 9, each azimuth row 46 has a cylindrical edge 48, with a series of vertical probes or radiating elements 50 and horizontal probes or radiating elements 52 being alternately arranged at the perimeter of the cylindrical edge 48 of the row 46. The probes 50 and 52 are employed to provide the transmit and receive electromagnetic energy beams. The electromagnetic energy beams are in the L-band region (1215 to 1400 Mhz).

Referring back to FIG. 8, the feed array 34 is implemented by riveting together a plurality of the individual rows 46 illustrated in FIG. 9. Blocks 53 are used to provide spacing between the rows 46 and to assist in forming a waveguide so that the troughs between the rows 46 match the radiating elements or probes 50 and 52 to free space. Further, as illustrated in FIG. 8, the rows 46 are formed of varying lengths, so that the feed array 34 has a stepped configuration along its edges.

It was determined that the preferred polarization characteristics for the antenna 30 of the present invention include the provision of a switchable circular polarization capability for operation in rain. In particular, the benefit of circular polarization is that it suppresses the rain substantially (15 dB) while only modestly (3 dB) reducing target detectibility, thereby providing excellent clutter visibility. Circular polarization is employed by all existing FAA air traffic control radars. The use of circular polarization, which can be switched in on a sector controlled basis, is a preferred approach to suppressing the effects of rain. It allows the use of a low pulse repeat frequency (PRF) mode in the rainy regions, while using reasonable transmitter power levels and avoiding the high loss, complexity and risk disadvantages of other options.

Vertical linear polarization is the preferred mode of operation in non-rainy areas because of its superior ability to control false alarms from sea clutter. Since circular polarization causes a 3 dB reduction in effective target cross-section as compared with linear polarization, it is important that the antenna 30 of the present invention also be capable of switching between circular and linear polarization, so that the circular polarization need be used only where necessary (i.e., in those sectors that contain rain). When circular polarization is in use, both right and left circular polarization outputs are available, one for the target detection channel, and the other for the weather detection channel. When the linear polarization mode is in use, the polarization is vertical rather than horizontal, because of the superior properties of vertical polarization against sea clutter. Sea clutter exhibits much more "spikey" behavior when horizontal polarization is employed than it does when vertical polarization is used. This causes attendant disadvantages with respect to constant false alarm rate (CFAR) circuit loss in the horizontal polarization case. Thus, in the present invention the linear polarization mode employs vertical polarization.

The probes 50 and 52 in FIG. 9 are vertical and horizontal radiating elements, respectively, which are employed to produce a switchable polarization capability between vertical polarization (only probes 50 actuated) and circular polarization (probes 50 and 52 both actuated). It should be noted that the use of vertical and horizontal radiating elements to generate circular polarization is known. An array of vertical and horizontal polarization elements can be formed by two sets of grooves in a ground plane, wherein the individual vertical and horizontal polarizing elements are separated by the grooves in the two orthogonal planes. The resulting individual elements have a wide bandwidth and are capable of excitation with circular polarization. The best bandwidth is obtained by making the grooves in two or more steps of unequal width, adjusted to obtain cancellation of the reactances.

Figure 10:
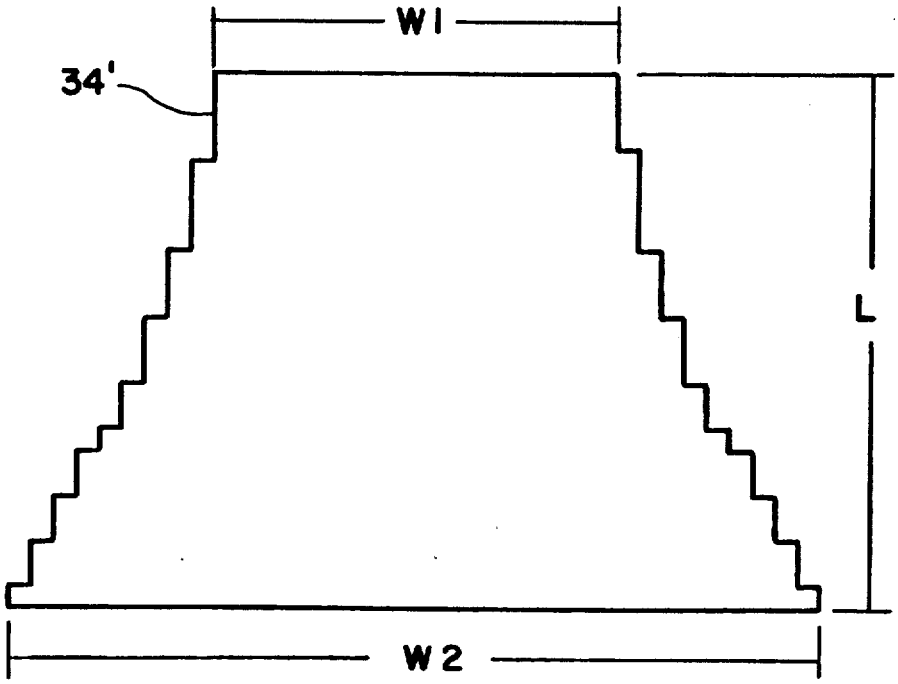
FIG. 10 is a plan view of the feed array 34 of the preferred embodiment of FIG. 2.

As indicated above, the feed array 34' has a cylindrical surface. Because of the dual parabolic contour of the reflector 32', a parabolic shaped feed array would actually be the best match for the reflector 32'. However, a cylinder is a close approximation. FIG. 10 is a schematic plan view of the preferred embodiment of the feed array 34' illustrated in FIG. 2. In this embodiment, the feed array 34' is made up of a series of 24 rows 46 (illustrated in FIG. 9) connected together to form the feed array 34'. As a result, the stepped configuration of FIG. 10 has a larger number of steps than the demonstration antenna 30 which was actually built and which is illustrated in FIGS. 1 and 8. The geometry of the feed array 34' is based on the focal lengths $F_x$ and $F_y$, and the shape of the reflector 32'. The feed array 34' has a width which varies between W1 and W2 and a length of L. In the preferred embodiment employing 24 rows, W1 is 9 feet (2.74 meters), W2 is 18 feet (5.49 meters) and L is 12 feet (3.66 meters). As indicated above, the foot (7.32 meters) radius. In the stepped configuration, the portions of the feed array 34' having the shorter widths are for the lower elevations, and the portions of longer width are for higher elevations.

In an alternate embodiment, the feed array 34 is an even ordered polynomial curved cylinder with an axis in the X-Z plane and tilted relative to the vertical axis. For an array contoured as a polynomial, normally a quadratic equation, the shape is expressed by the equation:

$$x\cos\Theta - x\sin\Theta = Z_o + Dy^2 \quad (2)$$

where $\Theta$ is the tilt angle of the feed array 34, $Z_o$ is the array offset in the z direction and D is a constant.

In the preferred embodiment, the feed array 34' has a dual stack configuration. This means that the 24 rows 46 in the preferred embodiment are divided into two groups or stacks of 12 rows each. Each of the 24 rows 46 in the preferred embodiment gives a single electromagnetic energy beam out in space. However, the single electromagnetic energy beam has high sidelobes (13 dB). Therefore, several rows are combined together and weighted to produce lower sidelobes. Each stack in the dual stack configuration is capable of producing five received elevation beams. The choice of five beams for the dual stack derives from the need to suppress ground clutter over a wide range of elevation angles. The received elevation beams are overlapped so that it is possible to determine the height of a target. This is because each target will show up in two adjacent beams and the relative offset between the two beams can be used to determine the height of the target. Multiple elevation beams are used in three-dimensional or height finding radars to add the third dimension. The angle is found by monitoring where the antenna is facing. The range is determined from the time delay between transmitting a narrow pulse until the reflection is received back. The height is determined by measuring the difference in dB between adjacent beam receptions, and comparing the difference in dB with the antenna calibration dB difference, and relating it to measured elevation angle. The height is computed from the range and elevation angle.

Figure 11:
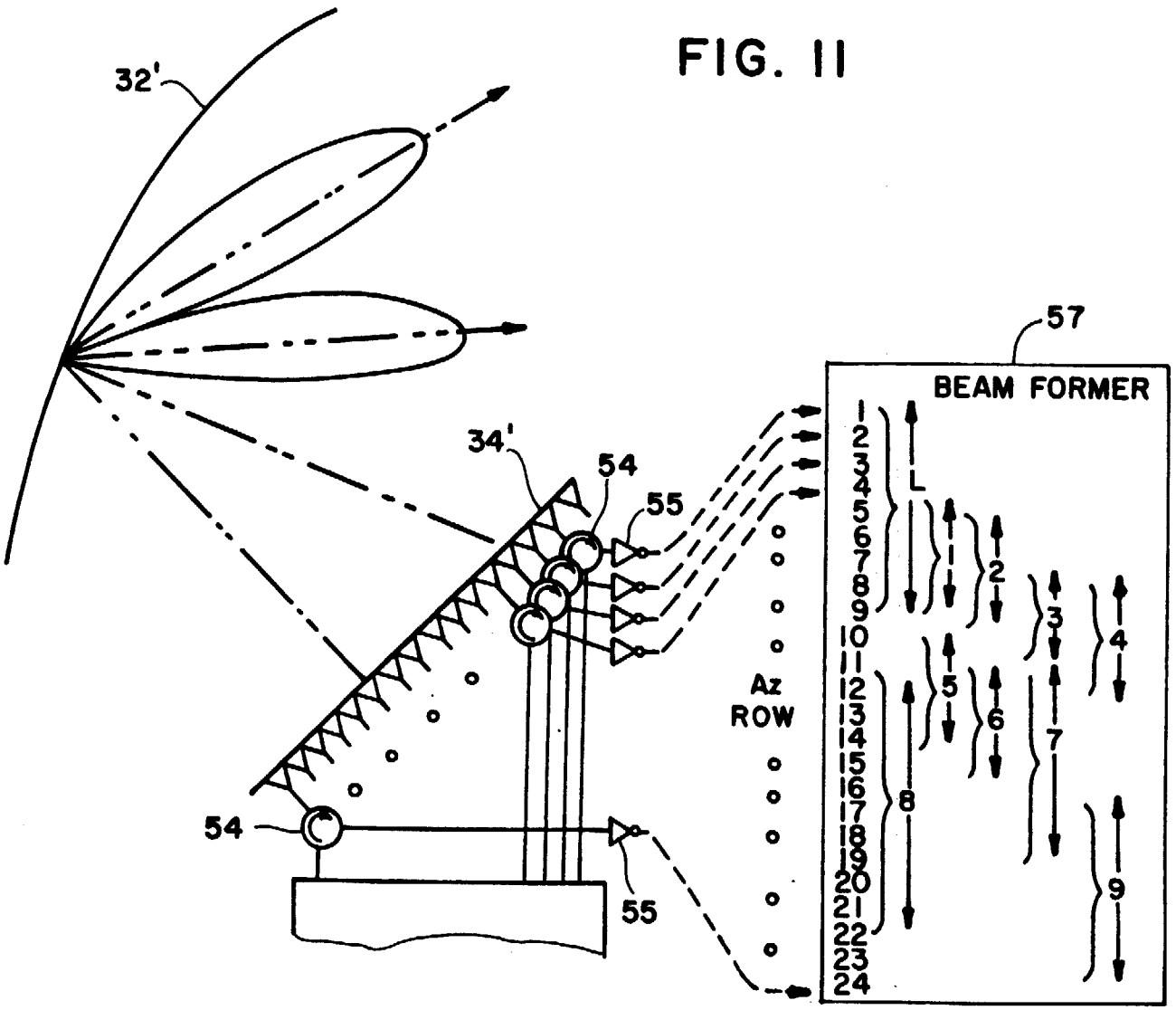
FIG. 11 is a diagram for illustrating the formation of received elevation beams based on the electromagnetic energy beams received by the individual azimuth rows.

FIG. 11 is a schematic diagram of the arrangement for combining the 24 single electromagnetic energy beams to form the ten received elevation beams: Circulators 54 are provided for each row 46 to control whether the electromagnetic energy beams are to be transmitted or received. Amplifiers 55 amplify the signals for each row 46. A known beam forming circuit 57 is used to form ten receive elevation beams based on the 24 rows 46 of the feed array 34'. The known beam forming circuit 57 employs air dielectric strip line combiners or other available circuitry (e.g., microstrip dielectric type circuits) to combine and weight the beams received from the 24 rows 46. As illustrated in FIG. 11, elevation beam 1 is formed by rows 5–9, elevation beam 2 is formed by rows 6–10, etc. Elevation beam L in FIG. 11 is formed by rows 1–9 and is directed to an alternate embodiment of the present invention wherein a lookdown elevation beam is generated when the antenna is positioned at a high spot geographically. This lookdown beam is also illustrated by dashed lines in FIG. 4.

In practice, the 24 beams from the 24 rows may be combined and weighted in any suitable manner to produce the desired type of elevation beams. It should be noted that the 24 received beams are independent and orthogonal. However, after combining the beams to achieve the ten elevation beams, adjacent beams are not orthogonal but are instead overlapping for height finding purposes.

Figure 12A:
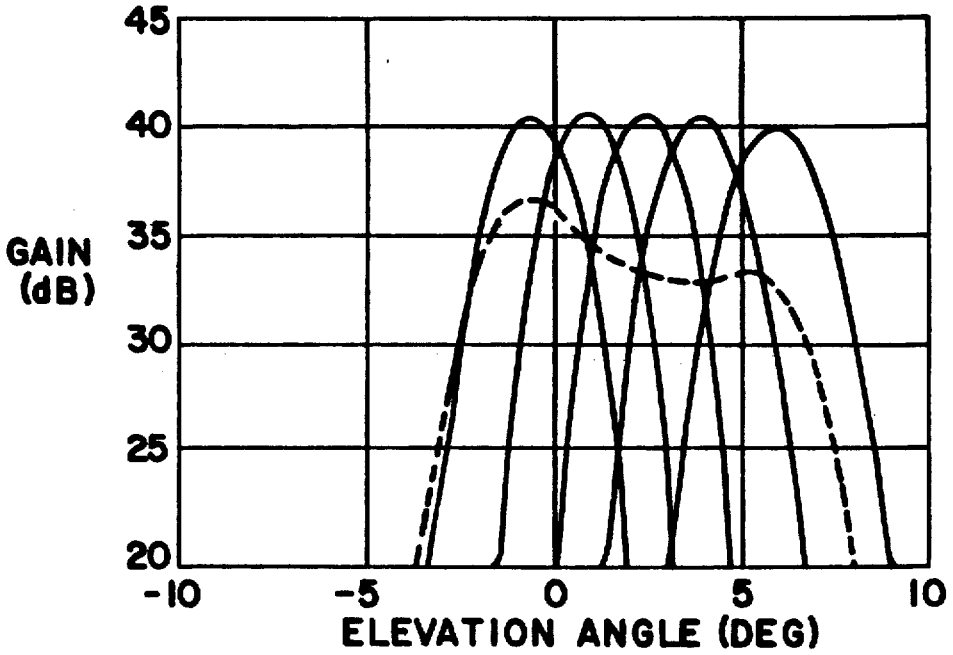
FIGS. 12A and 12B are graphs of the gain versus elevation for the transmit and receive elevation beams formed by the lower and upper stacks of azimuth rows, respectively.
Figure 12B:
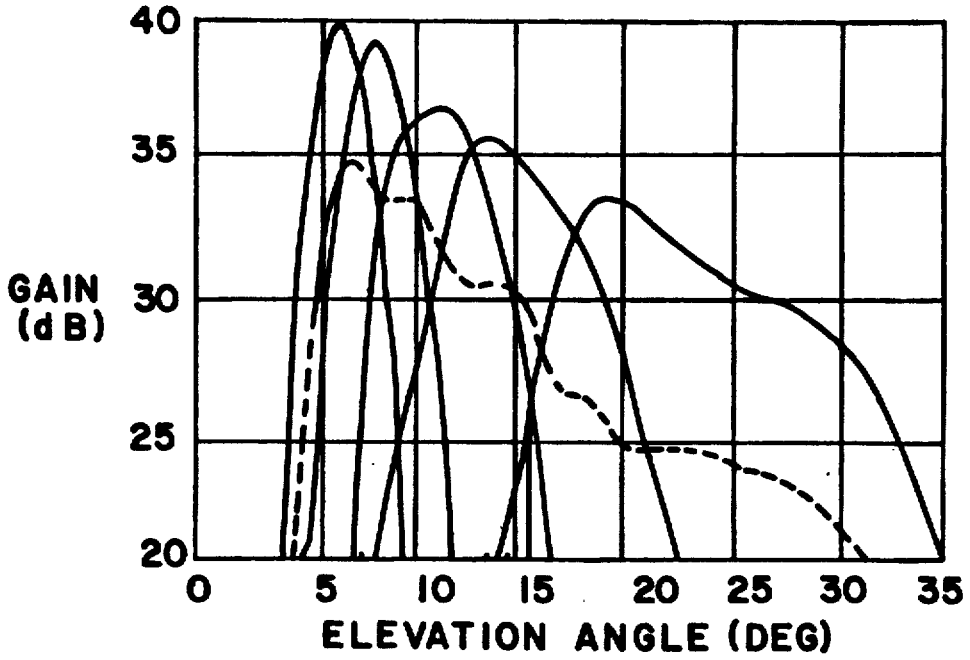

FIGS. 12A and 12B are graphs for illustrating the receive elevation beams (solid lines) and the transmit elevation beams (dashed lines) for the lower stack and the upper stack, respectively. The generation of the transmit elevation beams is described in detail below with respect to FIGS. 17, 18A and 18B. The receive elevation beams are described below. It should be noted that the lower stack covers elevation angles from approximately −7° to 5°, while the upper stack covers elevation angles from 4° to 30°. The uppermost receive beam of the lower stack and the lowermost receive beam of the upper stack share the same elevation position in order to provide continuity of elevation angle (height) measurement capability over the full elevation coverage. This is necessary because the waveforms and processing used for the two stacks are different. The five elevation beams in the lower stack (including the lookdown elevation beam) require ground clutter cancellation processing, but the five beams in the upper elevation stack do not require ground clutter cancellation processing because their two-way (transmit and receive) elevation pattern sidelobes are low at all elevation angles at which clutter is present. Therefore, no significant clutter return echoes occur in these beams. In order to derive the elevation angle, and hence height, by taking ratios of return amplitudes in adjacent elevation beam pairs, it is essential that both of the beams concerned use the same waveform and processing. Otherwise, the ratio and the associated derived height will be in error. Thus, the output of an upper beam in the low stack cannot be used together with the output of a lower beam in the upper stack to derive height accurately. To avoid this situation, the beam sets in the two stacks are overlapped by one beam as illustrated in FIGS. 12A and 12B.

The upper and lower stacks of elevation beams are used on an interleaved pulse basis. The upper stack coverage is obtained during the receive dead times of the variable interpulse period (VIP) transmission used for the lower stack. In this way, each elevation beam position obtains a continuous sequence of pulses as the antenna scans through the azimuth beamwidth, thereby maximizing the number of hits per beamwidth that are provided. This is important to ensure the best possible Doppler filtering against clutter in the lower beam stack and also the best possible azimuth accuracy and resolution.

Fewer hits per beamwidth are needed in the upper stack both because Doppler processing is not required as already noted and because the 100-kft (30,480 meter) limit to altitude coverage also limits the maximum target range in the upper stack beams, so that less transmit energy is needed than in the lower stack. Specifically, 3.4 hits per beamwidth are provided in the upper stack. Maximizing the number of hits per beamwidth is especially important in the lower stack for which Doppler processing is required to suppress surface clutter in order to get good velocity responses free of blind speeds. Smoothness of response over the entire velocity region up to 3,000 knots, is essential in order to meet the requirement of 80% detection probability ($P_D$) over 90% of all Dopplers without substantial excess sensitivity being necessary to compensate for dim speed regions in the response. The use of the VIP waveforms with many different interpulse periods and a corresponding number of available hits per beamwidth is used to achieve this goal. This sequential scanning beam approach provides for fewer hits because it must share its dwell time among multiple beam positions. In contrast, the approach described above provides 10 hits per beamwidth in the lower stack and uses a VIP sequence with nine different interpulse periods.

The portion of the surface of the reflector 32' needed to form a beam of a given beamwidth is divided into a grid covering the surface. Rays are reflected at the surface, as if it were a mirrored surface, about the normal at each grid point (in accordance with Snell's Law) and projected to the surface of the feed array 34'. This defines the optimum location for an element used to form this beam. For the beam to be separable, these points must cluster about a line across the feed array 34'. The constants defining the reflector 32' and feed array 34' geometry in the present invention were chosen so that a multiplicity of rows 46 are developed, corresponding to a set of adjacent elevation beams.

Figure 13:
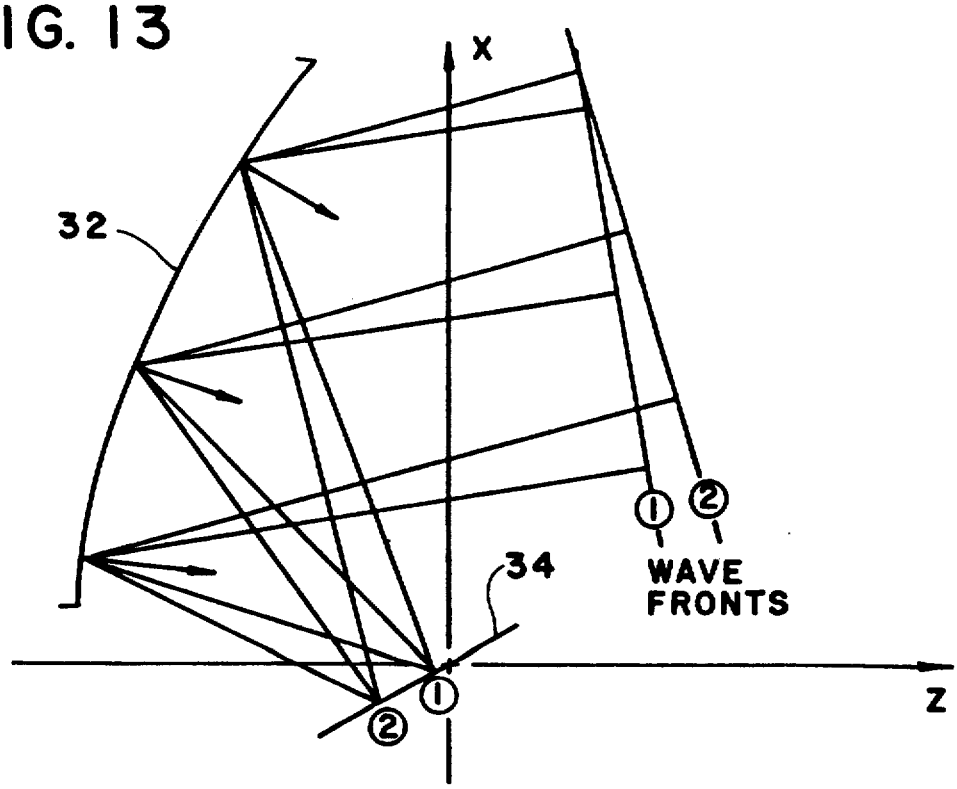
FIG. 13 is a diagram for illustrating the mapping of wavefronts onto the feed array 34.
Figure 14:
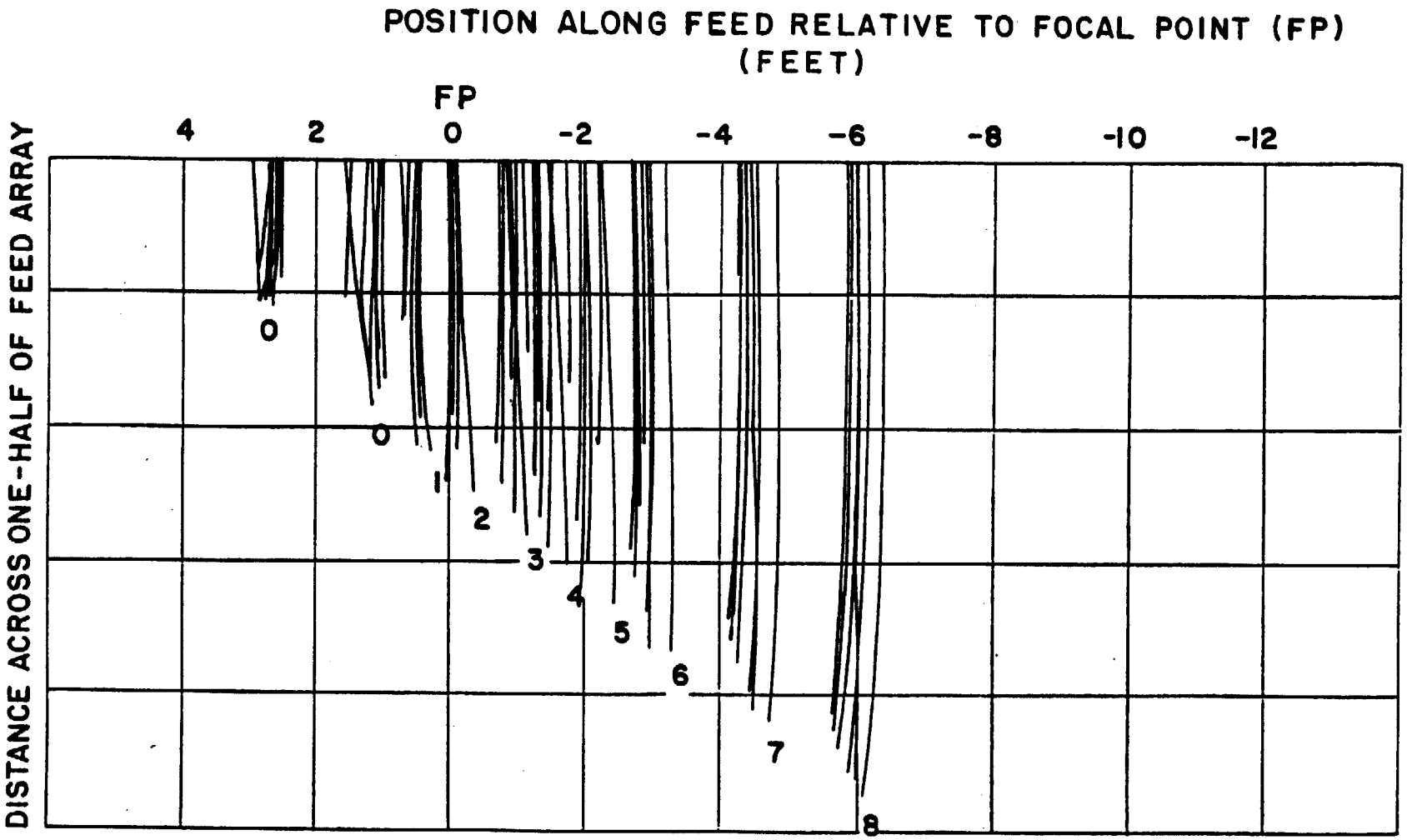
FIG. 14 is a graph showing the distance along the curved surface of the feed array 34 for points mapped into the feed array in accordance with the procedure described with respect to FIG. 13.

In the receiving mode, multiple projections are formed on the surface of the feed array 34' for many beam directions. In accordance with the present invention, the particular structure of the feed array 34 of FIG. 1 was designed by mapping a number of wavefronts over the entire reflector surface in the manner illustrated in FIG. 13. Since the reflector 32 and the surface of the feed array 34 are both curved, the mapping over the entire useable surface of the reflector 32, from each direction, maps into a line (or row) on the feed surface. FIG. 14 shows the optimum row and element locations for a set of 10 beams. FIG. 14 illustrates the relative position along the feed surface of the feed array 34' for one-half of the feed array 34'. As can be understood from FIG. 14, the width of the feed is seen to grow as the row is displaced from the focal point (where point O corresponds to the focal point), so that the step-like nature of the results illustrated in FIG. 14 corresponds to the stepped structure of the feed array 34'. FIG. 14 shows the position along the feed array 34' relative to the focal point in feet for plane waves at a variety of angles. The amplitude and phase for each row of radiating elements is determined by an iterative optimization process. The reflector contour and the length of the reflector 32' are varied to accommodate this characteristic and to arrive at the preferred embodiment for the reflector 32' which is described above.

Figure 15:
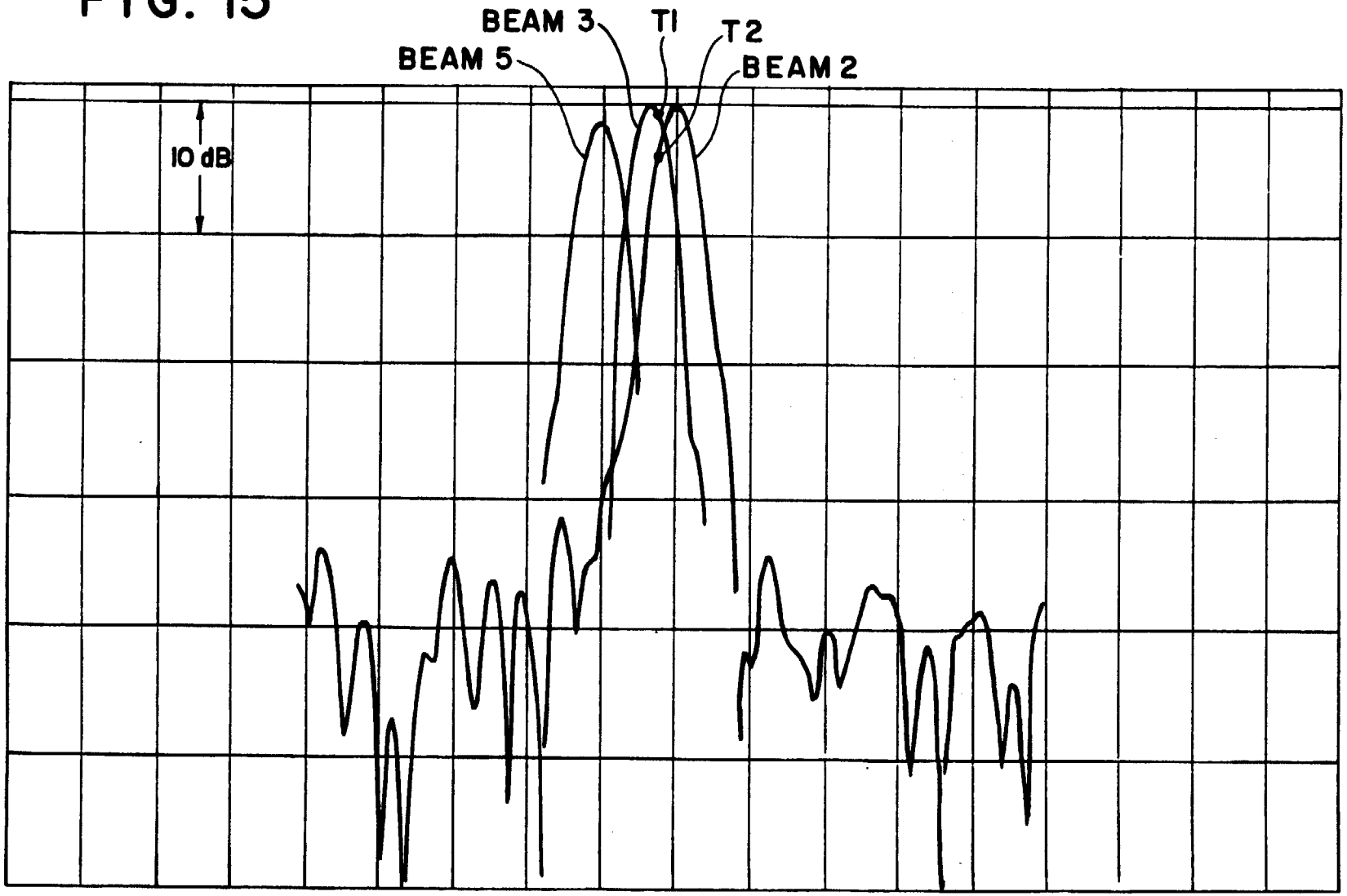
FIG. 15 is a graph of the three elevation beams which were developed in a test for the demonstration antenna of FIG. 1.

The demonstration antenna of FIG. 1 was developed in order to generate three receive elevation beams. These three receive elevation beams correspond to beams 2, 3 and 5 of the ten beam system illustrated in FIG. 11. FIG. 15 is a graph of the results which were produced when beams 2, 3 and 5 were simulated one at a time and then overlaid. As illustrated in FIG. 15, there is a crossover or partial overlap between the multiple elevation beams, which is used to determine the height of a target by determining the position of the target on the two adjacent beams. For example, a target which shows up at point T1 on beam 3 will also appear at point T2 on beam 2.

Figure 16A:
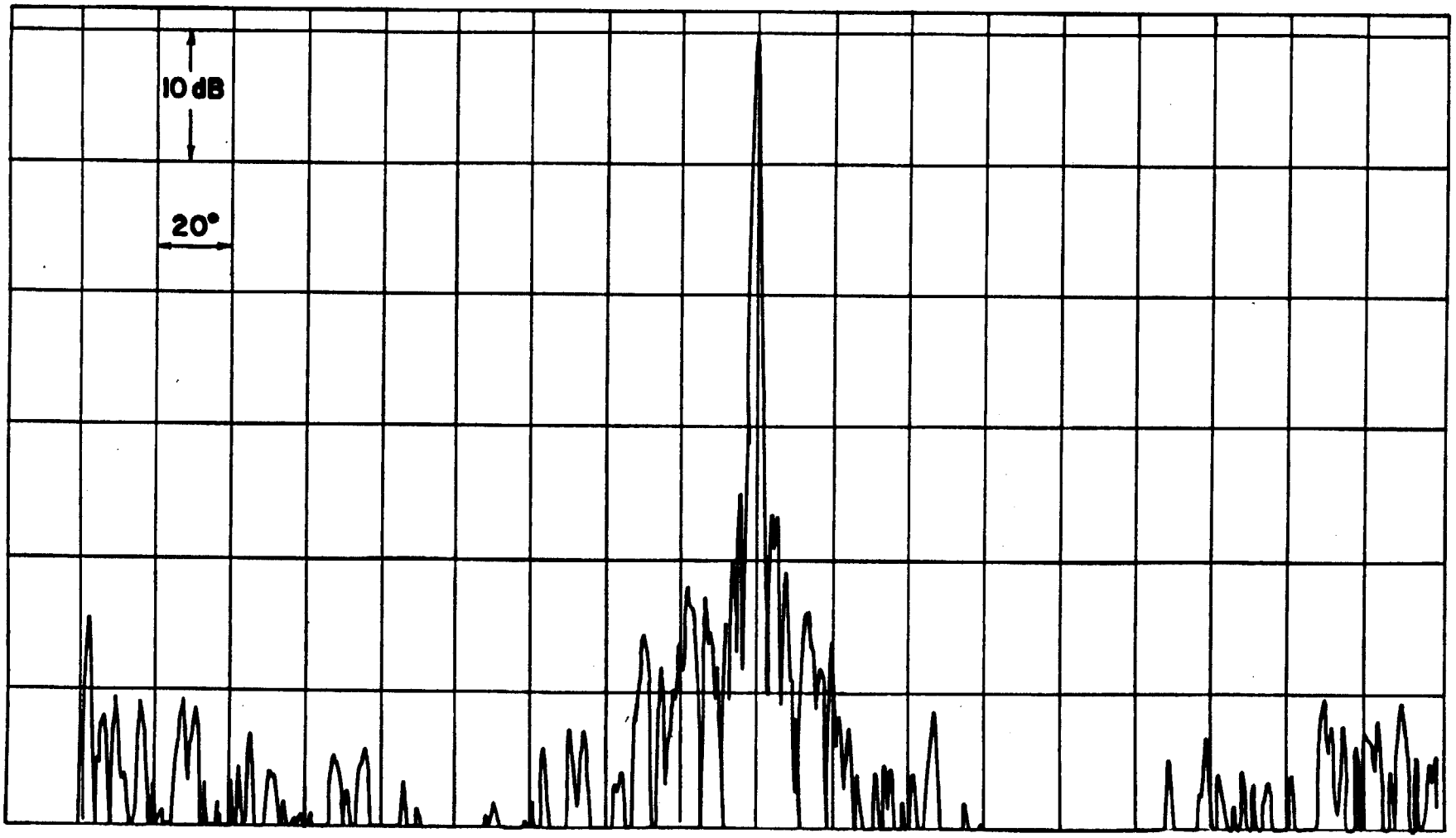
FIGS. 16A and 16B are graphs of the results of a simulation for azimuth beams 3 and 5 of the antenna of FIG. 1, which illustrates sidelobes of greater than 30 dB.
Figure 16B:
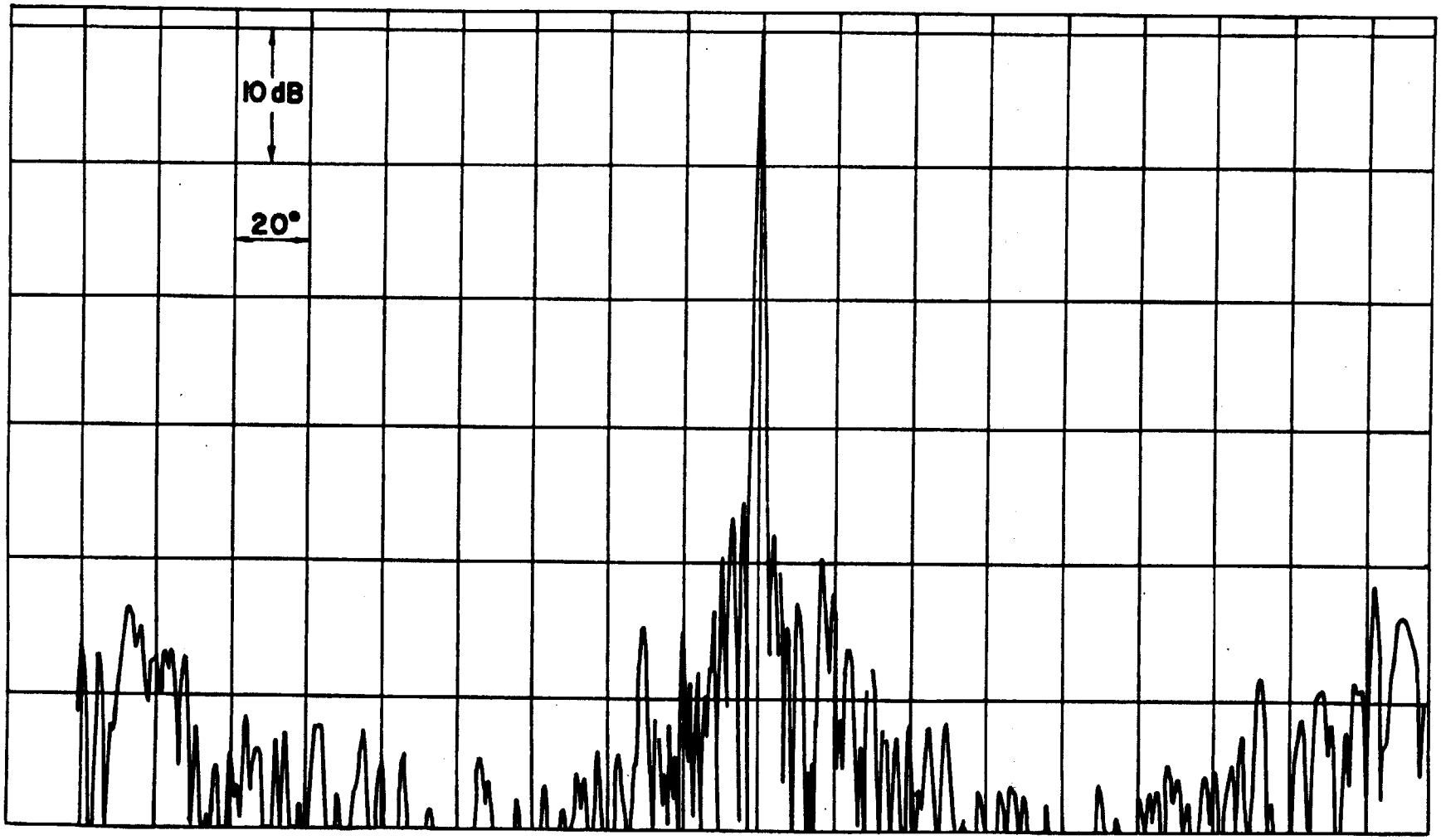

FIGS. 16A and 16B are graphs showing the results of an azimuth pattern produced for receive beams 3 and 5, respectively, of the demonstration antenna of FIG. 1, as the antenna is swung across the horizon. As is apparent from FIGS. 16A and 16B, the beams which are produced have very low sidelobes (more than 30 dB). These test results were obtained by providing a test signal to the demonstration antenna 30 and analyzing the output of the beamformer 57 to produce the graphs of FIGS. 16A and 16B. The demonstration antenna 30, reflector 32 and feed array 34 formed three beams of a ten beam system in the elevation plane. The worst azimuth sidelobes for each beam were as follows:

| Beam | Worst sidelobe |
|---|---|
| 2 | −36.3 dB |
| 3 | −31.5 dB |
| 5 | −35.7 dB |

In the newest types of radar systems, more than one transmit beam in elevation is required. These transmit beams, which are not orthogonal, are created from orthogonal inputs and require the sharing of several azimuth rows of radiating elements. Conventional approaches inherently add sharing loss. This reduces the efficiency and requires more transmit power for the required coverage. The hybrid transmit beam switching network of the present invention provides a means for creating the transmit beams with no sharing loss.

The dual stack beam approach requires a dual transmit beam capability to illuminate the two elevation beam coverage regions. Thus, the transmit beams illustrated in FIGS. 12A and 12B are produced by the lower and upper stacks, respectively. Each of the two transmit beams provides a fan pattern covering the elevation regions spanned by the associated stack of receive beams. Certain of the azimuth rows of radiating elements (e.g., rows 11-14 in a 24 row implementation) must be actuated for each of the two transmit beams. The two elevation regions are illuminated sequentially in time, on an interleaved pulse basis.

Figure 17:
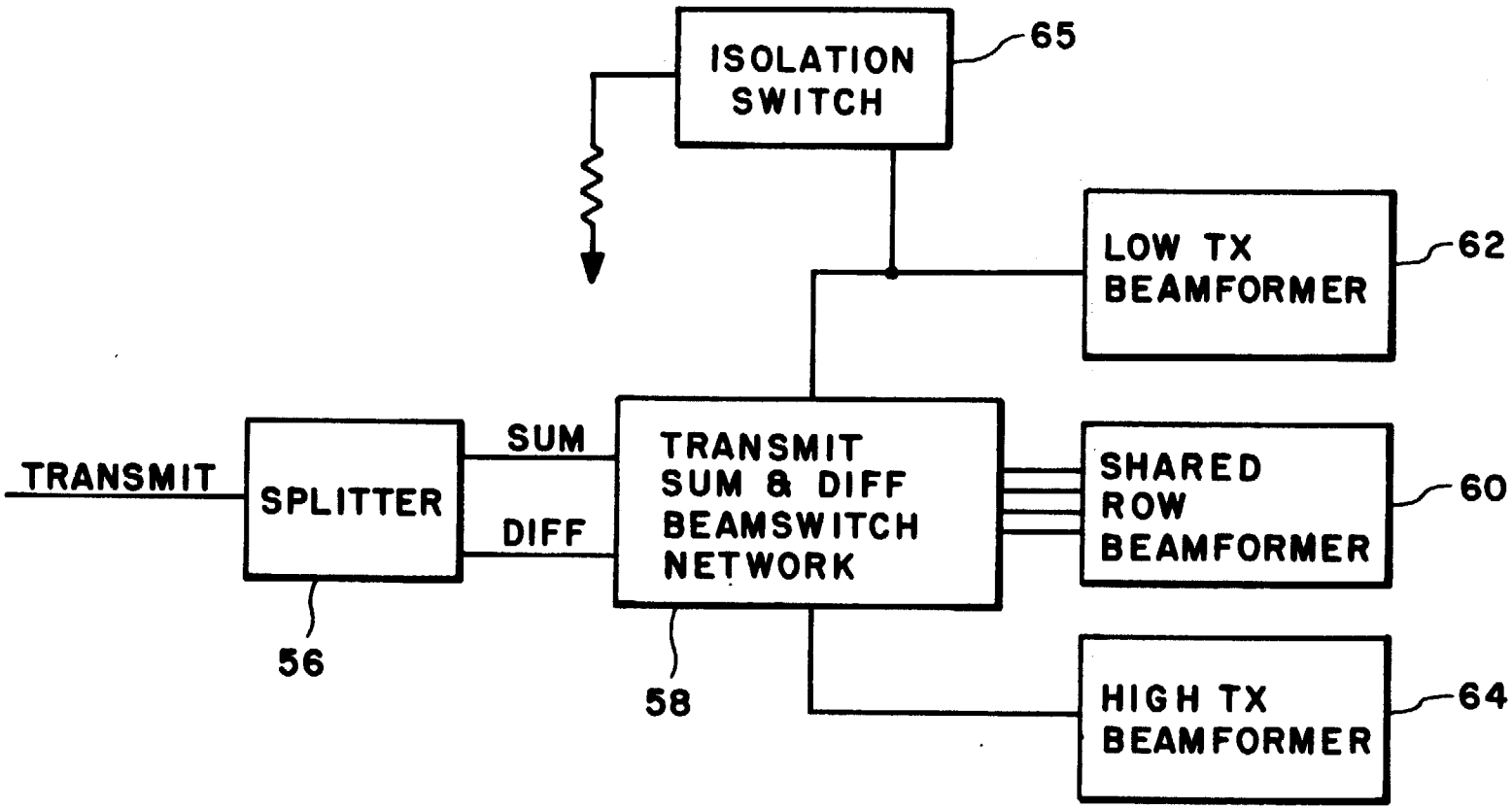
FIG. 17 is a block diagram of the hybrid beamswitch network in accordance with the present invention.

FIG. 17 is a block diagram of the hybrid transmit beam switching network in accordance with the present invention. A transmit signal is split by a splitter 56 into a sum signal and a difference signal. The splitter 56 acts as a means for providing first and second beam actuation signals (corresponding to the sum signal and the difference signal) based on the transmit signal. The power of the transmit signal is split unequally between the sum signal and the difference signal. For example, two-thirds of the power may be in the sum signal and one-third of the power in the difference signal or vice versa. For the sum signal, in-phase components are added (i.e., a positive voltage vector), while in the difference signal, out-of-phase components are added (i.e., a negative voltage vector). A transmit sum and difference beamswitch network 58 receives the sum and difference signals and actuates selected ones of the 24 rows 46 which make up the feed array 34'. In particular, the transmit sum and difference beamswitch network 58 actuates a shared row beamformer 60 and one of the low transmit beamformer 62 and the high transmit beamformer 64. The low and high transmit beamformers 62 and 64 alternately actuate the non-shared rows. For example, there may be ten low beam rows, ten high beam rows and four shared rows. The sum signal and the difference signal are fed separately to the transmit sum and difference beamswitch network 58, and the voltage and phase on the shared rows is altered by the transmit sum and difference beamswitch network. If the power is switched off for the high transmit beamformer 64, then the low transmit beamformer 62 is turned on, and the power to the shared row beamformer 60 is altered. The phase and amplitude of the power supplied to the shared row beamformer 60 changes in dependence upon whether the high transmit beamformer 64 or low transmit beamformer 62 is being turned on with the shared row beamformer 60.

The isolation obtained by the hybrid switch alone (approximately 20 dB) would be insufficient when the switch is set for upper stack illumination. Therefore, isolation is further enhanced by an isolation switch 65 that shunts the hybrid leakage power away from the lower stack transmit beam when the switch is set to the position for upper stack illumination. Since the isolation switch 65 operates under the upper stack illumination conditions only, its power handling requirements are only those of the hybrid switch leakage. The isolation switch 65 may be implemented as a reflector type diode device to provide 25 dB of additional isolation.

Figure 18A:
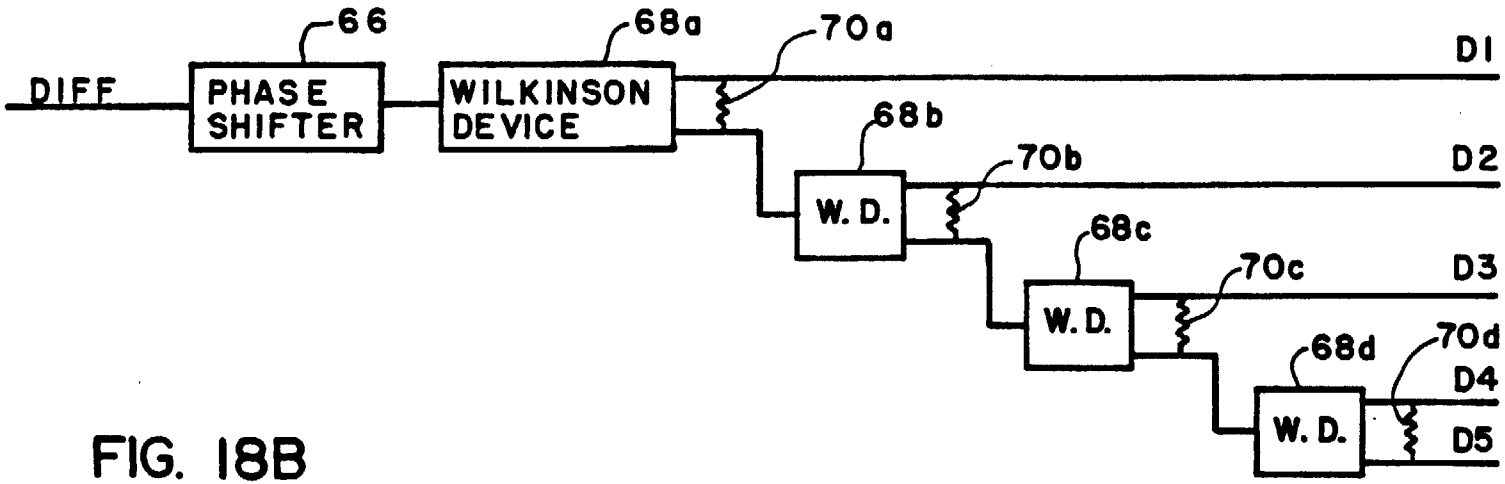
FIGS. 18A and 18B form a block diagram for the transmit sum and difference beamswitch network 58 of FIG. 17.
Figure 18B:
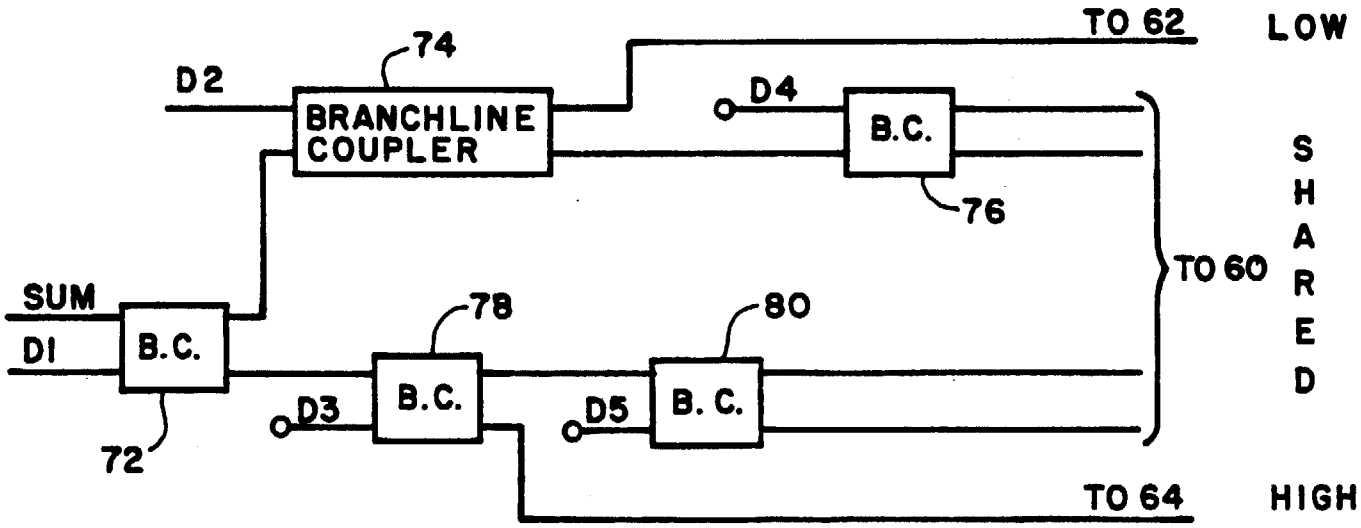

FIGS. 18A and 18B are block diagrams which together form the transmit sum and difference beamswitch network 58. The difference signal is provided to a phase shifter 66 which serves as a means for phase-shifting the difference signal (i.e., the first beam actuation signal), and the phase-shifted difference signal is then provided to a series of Wilkinson devices 68*a*-68*d* which serve as a divider network to produce phase-shifted difference signals D1-D5, respectively. Since the phase of the input to a Wilkinson device does not affect the relative phases of its outputs, the phase-shifted difference signals D1-D5 each have the same phase with respect to each other. Resistors 70*a*-70*d* are respectively provided across the outputs of the Wilkinson devices 68*a*-68*d*.

The sum signal and the phase-shifted difference signal D1 are provided to a branchline coupler 72. A branchline coupler is a hybrid coupler wherein the phase relationship of the inputs affects the outputs. For example, an input at power P may be provided on one input which produces a portion of power on each of the two outputs. Further, the two outputs may be phase-shifted to be at 90° and 180°, respectively. Thus, a branchline coupler may be implemented in a variety of ways to produce desired phase and power differences at the outputs. One output of the branchline coupler 72 is provided as an input to a branchline coupler 74. The other input of the branchline coupler 74 is the phase-shifted difference signal D2. The branchline coupler 74 produces one output which is provided to the low transmit beamformer 62 and another output which serves as an input of a branchline coupler 76. The other input of the branchline coupler 76 is the phase-shifted difference signal D4. The branchline coupler 76 produces two outputs which are provided to the shared row beamformer 60. A second output of the branchline coupler 72 is provided as an input to a branchline coupler 78. The other input of the branchline coupler 78 is the phase-shifted difference signal D3. One output of the branchline coupler 78 is provided to the high transmit beamformer 64, and the other output of the branchline coupler 78 is provided as an input to a branchline coupler 80. The other input of the branchline coupler so is the phase-shifted difference signal D5. The outputs of the branchline coupler 80 are provided to the shared row beamformer 60. As illustrated in FIGS. 18A and 18B, the difference signal is phase-shifted by the phase shifter 66, divided by the Wilkinson devices 68*a*–68*d* and then provided to the branchline couplers 72, 74, 76, 78 and 80 to produce the outputs to the low transmit beamformer 62, the high transmit beamformer 64 and the shared row beamformer 60. By varying the amplitude and phase input to the branchline coupler 72, the output profiles of the branchline couplers 76 and so to the shared row beamformer 60 is varied to produce a different taper profile for the shared rows depending upon whether the high transmit elevation beam or the low transmit elevation beam is being generated. The power levels of the profile are different because of the different power inputs of the sum and difference signals. In summary, branchline couplers 72 and 74 and Wilkinson devices 68*a* and 68*b* form a means for turning off the low transmit row based on the first and second beam actuation signals (i.e., the sum and phase-shifted difference signals). Branchline couplers 72 and 78 and Wilkinson devices 68*a* and 68*c* serve as a means for turning on the high transmit rows based on the phase shifted first and second beam actuation signals (i.e., the sum and phase-shifted difference signals). Finally, Wilkinson devices 68*a*–68*d* and branchline couplers 72, 74, 76, 78 and so serve as a means for turning on the shared row beamformer 60 with a first profile when the first transmit rows (the low transmit rows) are actuated and for turning on the shared row beamformer 60 with the second profile when the second transmit rows (i.e., the high transmit rows are actuated).

In accordance with the present invention, transmit switching between the two illumination beams is provided in a low loss implementation by the combination of hybrid junctions incorporated into the antenna feed manifold (i.e., array 34), and low level phase control at the inputs to subsections of the solid state transmitter. The overall loss including the manifolding and the embedded hybrids is 0.75 dB. The phase shifter losses are insignificant because the phase shifter control is done at low level. The transmit sum and difference beamswitch network 58 of the present invention employs standard branchline and Wilkinson couplers, thereby allowing the use of several types of media (strip line, coaxial cable, etc.). Therefore, power handling is only bounded by the medium chosen. The particular hybrid network was obtained by calculating the sum and difference distributions from their required row distributions. The phase correction was added to result in a minimum correlation between the sum and difference signals. This correction does not affect the pattern since it is uniform across the rows. Once the sum amplitudes are determined, the four port coupler values are calculated. By using these coupler values and the row voltages, the desired amplitude and phase at the difference port can be computed.

The system of the present invention may be implemented in numerous ways. For example, the reflector 32′ may be implemented solely with the dual parabolic shaped portion, while omitting the bottom portion of the reflector 32′ if radar coverage for elevations above 20° is not required. In addition, the number of rows 46 in the distributed feed array 34′ can be varied in accordance with the requirements of the specific antenna system. In addition, the particular hybrid network used as the transmit sum and difference beamswitch network 58 can be varied so long as the switching which occurs takes place as a result of a phase difference, as opposed to a switching operation.

The distributed array fed reflector antenna of the present invention enables the aperture illumination function to be correctly shaped for sidelobe control while using a minimum number of the radiating elements that are necessary to provide the required dual (linear/circular) polarization capability. The approach also minimizes the number of low noise amplifiers (LNA) required within the radiating structure for received beam formation.

The transmit sum and difference beamswitch network 58 is formed by a single hybrid package including intertwined sum and difference distributions. This unique design allows several rows to be shared with no loss associated, and requires no switches. The switching from one transmit beam to the other is accomplished through a phase shift between the sum and difference ports.

The many features and advantages of the invention are apparent from the detailed specification and thus it is intended by the appended claims to cover all such features and advantages of the system which fall within the true spirit and scope of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. An antenna comprising:

a reflector having a portion with a dual parabolic shape, wherein said portion of said reflector has a horizontal focal length and a vertical focal length which is less than the horizontal focal length; and a distributed feed array for transmitting and receiving a plurality of electromagnetic energy beams, and distributed feed array positioned adjacent to and offset from, said reflector, so that said reflector reflects the transmitted and received electromagnetic energy beams, said distributed feed array having a curved surface including a plurality of rows of radiating elements.

2. An antenna as set forth in claim 1, wherein said curved surface is cylindrical.

3. An antenna as set forth in claim 1, wherein said reflector and said feed array are mounted on a support structure.

4. An antenna as set forth in claim 3, wherein said reflector comprises:

a support grid structure extending from said support structure; and a mesh fastened to said support grid structure, said mesh having a portion with the dual parabolic shape.

5. An antenna as set forth in claim 1, wherein said plurality of rows of radiating elements are coupled together.

6. An antenna as set forth in claim 5, wherein each of said plurality of rows of radiating elements includes vertical radiating elements and horizontal radiating elements, and wherein said distributed feed array includes means for selectively actuating said horizontal and vertical elements to selectively provide vertical polarization and circular polarization.

* * * * *